US008733984B2

(12) United States Patent
Harkam et al.

(10) Patent No.: US 8,733,984 B2
(45) Date of Patent: May 27, 2014

(54) LED LUMINAIRE AS A REPLACEMENT FOR INCANDESCENT LIGHT BULBS

(75) Inventors: Norbert Harkam, Undenheim (DE); Juergen Honold, Cologne (DE)

(73) Assignee: Ledo LED Technologie GmbH, Nieder-Olm (DE)

( * ) Notice: Subject to any disclaimer, the term of this patent is extended or adjusted under 35 U.S.C. 154(b) by 54 days.

(21) Appl. No.: 13/638,894

(22) PCT Filed: Mar. 23, 2011

(86) PCT No.: PCT/EP2011/054486

§ 371 (c)(1),
(2), (4) Date: Oct. 30, 2012

(87) PCT Pub. No.: WO2011/120862

PCT Pub. Date: Oct. 6, 2011

(65) Prior Publication Data

US 2013/0039035 A1 Feb. 14, 2013

(30) Foreign Application Priority Data

Mar. 31, 2010 (DE) ..... 10 2010 013 538

(51) Int. Cl.
*F21V 21/00* (2006.01)

(52) U.S. Cl.
USPC ..... 362/373; 362/294; 362/249.02; 362/650; 362/311.02

(58) Field of Classification Search
CPC ..... F21Y 22/22; F21V 29/2206
USPC ..... 362/95, 650, 373, 249.02, 311.02
See application file for complete search history.

(56) References Cited

U.S. PATENT DOCUMENTS

| | | | | |
|---|---|---|---|---|
| 7,434,964 | B1 * | 10/2008 | Zheng et al. | 362/294 |
| 7,513,653 | B1 * | 4/2009 | Liu et al. | 362/294 |
| 8,330,355 | B2 | 12/2012 | Emde | |
| 2007/0159828 | A1 * | 7/2007 | Wang | 362/294 |
| 2010/0201284 | A1 | 8/2010 | Kraus | |
| 2011/0156584 | A1 * | 6/2011 | Kim | 315/32 |
| 2012/0188771 | A1 | 7/2012 | Kraus et al. | |

FOREIGN PATENT DOCUMENTS

| | | |
|---|---|---|
| CN | 201386989 | 1/2010 |
| DE | 202005017767 | 3/2006 |

(Continued)

OTHER PUBLICATIONS

International Search Report for PCT/EP2011/054486, English translation attached to original, Both completed by the European Patent Office on May 23, 2011, All together 6 Pages.

*Primary Examiner* — Evan Dzierzynski
(74) *Attorney, Agent, or Firm* — Lowe Hauptman & Ham, LLP

(57) ABSTRACT

The problem addressed by the present invention consists in providing an LED luminaire which corresponds to the known shapes for incandescent bulbs both in terms of contour and size and which enables illumination similar to that of an incandescent bulb by means of the light-emitting means both in terms of the emission response and the luminous intensity of said luminaire. The heat sink which is required for technical reasons and which bears the light-emitting means itself predetermines the shape of the incandescent bulb and the emission of the LEDs for this purpose. The heat sink can in this case be in the form of one body or can comprise a plurality of separate heat sinks, which are arranged about a central axis so as to be associated with the respective light-emitting means.

13 Claims, 12 Drawing Sheets

(56) References Cited

FOREIGN PATENT DOCUMENTS

Figure 1:
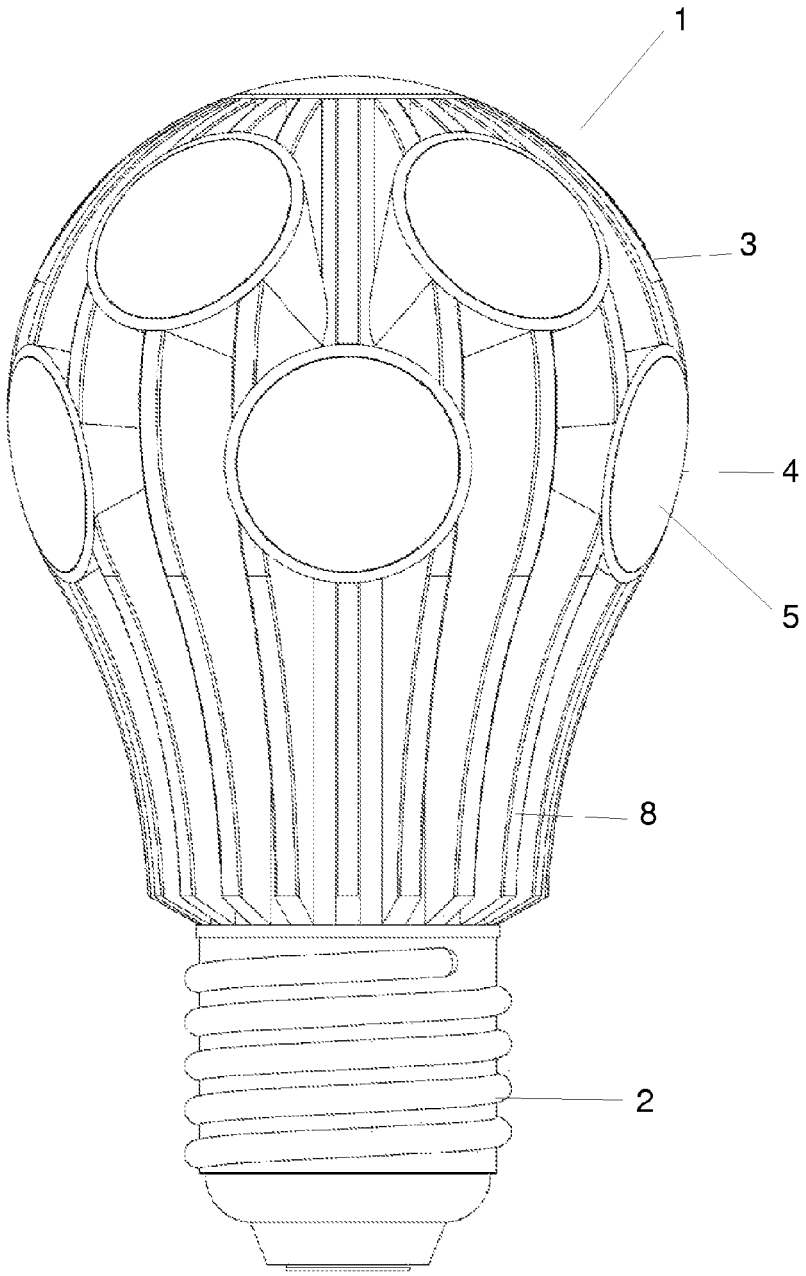

| | | |
|---|---|---|
| DE | 202007008258 | 10/2007 |
| DE | 102007037820 | 2/2009 |
| DE | 202008015948 | 2/2009 |
| DE | 202008016870 | 3/2009 |
| DE | 102007045540 | 4/2009 |
| EP | 2077414 | 7/2009 |
| WO | 2009074322 | 6/2009 |
| WO | 2009083853 | 7/2009 |

* cited by examiner

LED LUMINAIRE AS A REPLACEMENT FOR INCANDESCENT LIGHT BULBS

CROSS-REFERENCE TO RELATED APPLICATION

This application is the U.S. national phase of PCT Appln. No. PCT/EP2011/054486 filed on Mar. 23, 2011, which claims priority to German Patent Application No. 10 2010 013 538.0 filed on Mar. 31, 2010, the disclosures of which are incorporated in their entirety by reference herein.

The invention is about a LED light in accordance with the generic term of the patent claim 1.

In comparison to common light sources, light emitting diodes (LEDs) have clear advantages. These advantages are for example a higher lifespan and reliability, but especially a significantly lower energy consumption, which increases the efficiency of this light source in comparison to conventional light sources. However, the use of light emitting diodes has been limited to particular fields of application up to now, for example in signalling, and couldn't replace the conventional illuminants in domestic use.

The main problem here is that light emitting diodes aren't strongly thermally loadable. Here, the LEDs show a dependence of the operating temperature to the luminous flux as well as the lifespan, whereby in the case of an increase in temperature of approx. 50 degrees Celsius generally (starting from a value of 25 degrees Celsius) the radiance performance of the LEDs is reduced by around 15 percent and the lifespan sinks to less than half.

While constructing LED lights attention should be paid to the fact that a colder surrounding increases efficiency and lifespan of the LEDs. Therefore the heat regulation of the LED illuminant is a central factor in development, where care has to be taken that the heat is led away from the LED illuminant in a controlled manner, in order to avoid heat accumulation.

Besides these efforts concerning the controlled heat dissipation of the LED illuminant, electronic components are necessary, because the LEDs can't run directly on the power supply system. Therefore a significant effort in development is necessary to establish LEDs in the sector of domestic lighting technology.

In the last years, there have been several attempts to make progress in the use of LED technology in the sector of conventional illuminants. As already mentioned, the point of heat dissipation is here very central. At the same time it is noticeable that there is the effort in the sector of domestic lighting technology to offer the customers an alternative product which has the design of his familiar illuminant, namely the design of a classic light bulb.

Generally it is tried to retain the shape of light bulbs as a kind of basic body, that means a girder for the LED with the appropriate electronically required components, embedded in a closed body which is bulb-shaped. Such disclosures are written in DE 20 2008 016 870 U1, DE 10 2007 045 540 A1, DE 20 2008 015 948 U1, WO 2009/083853 A1, WO 2009/074322 A1, EP 2 077 414 A1 as well as DE 20 2005 017 767 U1.

It is always about assembled systems which have a lamp socket for screwing into an appropriate lamp holder, from which the nearly bulb-shaped transparent hollow body emanates, like the familiar light-bulbs, that includes the real illuminant. This body could be made of glass, plastic or other translucent materials.

Various disclosures can be found here of how the light sources have to be arranged inside this translucent closed body. The utility model specification DE 20 2007 008 258 U1 shows a technical solution already offered, where there is a heat sink with a large surface in the shape of a bulb connected to the lamp socket for the power connection of the illuminant. On the flat upper end of this heat sink is a plate-shaped arrangement of LEDs mounted, which allows the direct absorption of the heat produced by the LEDs of the heat sink. This device is closed by the mentioned transparent hollow body, which could be for example shaped like a half shell, which gives that construction also the characteristic basic form of a light bulb.

One basic problem of the LED lights in the shape of a light bulb, which are presented on the market, is especially this spotlight effect. This means, the light radiation is not widespread like it is with light bulbs, but rather strongly directed forward, because of the flat arrangement of the LEDs on a circuit board and the arrangement at the front of the bulb-shaped body.

Also in the overall appearance of this alternative light bulb on LED basis, this special construction type is characteristic. In contrast to conventional light bulbs where the radiance comes from the whole body, they seem to be divided into two parts, because of the half shells and the basis which functions as a heat sink Additionally, these bulbs are often larger than conventional light bulbs, because otherwise there wouldn't be enough room for the needed size of the heat sink, to achieve a brightness comparable with light bulbs.

Generally it is worth noting, that there are several suppliers, who offer similar models which are based on this technical construction, that has, going out from the thread, featuring a heat sink taking up nearly the half of the total length of the illuminant, with the result, that there is only the front part of the LED light for emitting light. Furthermore it is noticeable, that these light bulbs don't have the quality of light which the conventional ones have. This affects the emission in all directions and the real light output, which is often lower than stated by the manufacturer and therefore below the value that conventional light bulbs show.

Especially the problem of the radiation angle results in these constructions, that the LED lights can't even give the optical feeling of conventional light bulbs.

The purpose of the present invention is therefore, to create a LED light according to the generic term of the principal claim, which meets the contour and size of the conventional shape of the light bulbs, as well as in their radiation pattern and the light output, which allows an illumination similar to normal light bulbs.

This is achieved by the invention of a LED light in accordance with the attributes of claim 1.

The subclaims 2 till 11 involve an advantageous construction of this invention.

The central idea of this invention was to achieve the character of a light bulb in such a way that the illuminant carrying and technically necessary heat sink itself should give the shape of a light bulb as well as the light output of the LEDs. The heat sink can be shaped as a body or assembled of several separate heat sinks, which are assigned to the respective illuminants, arranged around a central axis.

In contrast to the solutions already known and described in detail, where for example outgoing from the thread nearly two thirds of the body of the bulb form the heat sink, which also already resembles part of the light bulb with its shape, although the front third of the body of the bulb closes with a half-shell-shaped transparent "vault", which includes the real illuminant and therefore takes on the glass bulb character of a light bulb, the subject matter of this invention takes a completely new path.

The subject matter of this invention completely does without this transparent bulb-like body that includes the LEDs, with the result that the shaping of the LED light is solely defined by the specification of the heat sink or rather the heat sinks. A transparent bulb or half-bulb which is recreated from the shape of a light bulb is no necessary part of the integral construction of the illuminant and would only have a decorative character, for example with the shape of a lamp body going out from the thread completely encompassing an applied silicone cover with air holes.

In a first version of the LED light, the heat sink presents LED lights, which are arranged on the surface of the bulb-shaped heat sink, whereby the direction of the radiation of these illuminants is given by the bulb-shape of the heat sink and therefore an even and almost all-round radiance of light can be achieved.

Another advantageous version of the invention with several heat sinks, LED illuminants with respective one covered heat sink, which are arranged in such a way, that there is a bulb-like contour, whereby the direction of the radiation of these illuminants is given by the general bulb-shaped arrangement and therefore an evenly and nearly all-round radiation of light can be achieved, as it is also described in the first version.

It is a central characteristic of this invention that the LEDs arranged on the heat sink aren't mounted plane and flat on the circuit board but that there are several LEDs or small groups of LEDs with lower power, which are mounted evenly in or rather on the heat sink(s) along the contoured light bulb and follow in that way the direction of their radiation. In addition to the even radiation of the LED light, this has the advantage, that the LEDs which are normally mounted next to each other, in this invention are placed on the heat sink(s) and their projected bulb surface, with the effect, that they don't heat up each other and this increases the lifespan of the LEDs and also their power of radiation.

Additionally this invention allows to use a single heat sink, or assembled of several heat sinks, in a maximum size, namely inside the whole LED light. In contrast to the previously outlined solutions, this way enables the use up to three times as much cooling surface of the total LED light, as is possible in conventional solutions. Because of this technical initial situation, the problem of equipping such a light bulb with a brightness which is comparable with the ordinary brightness of common light bulbs, is solved, because the main question regarding the cooling efficiency is solved. At the current state of the art it is possible to realize the replacement of a conventional 60 watt light bulb with a colour temperature of 2900 Kelvin.

Moreover this invention allows, according to the structural shape constructed of several heat sinks, that are assigned at least one LED illuminant each, that the ambient air flows evenly around the modules, independently of the operational angle of the lamp, and allows in that way an optimal convection, hence a heat dissipation of the individual modules to the ambient air. The heat is here given off to the direct surrounding of the LED. Therefore there are no losses of cooling efficiency by thermal resistance of the material along the transmission path of the heat inside the heat sink, for example from the LED on the top to the lower edge of the LED light, as in the first version.

By this direct heat dissipation, it is possible to reduce the part of the heat sink in the light further, because the cooling is further optimized. This has advantages compared with version 1 regarding the manufacturing costs, because there is no need for a "carrying" heat sink anymore, which is relatively complicated in its construction and therefore cost-intensive in manufacturing. Finally this structural shape enables the mounting or rather maintenance of the illuminant, if this light is seen in modular construction, where the individual heat sink with their LED illuminants can be changed if needed.

The positive effect of this basis construction is, that the efficiency of the LEDs is increased, the LEDs or rather the LED light have a very long lifetime, the colour rendering properties and therefore a better quality of light can be achieved, because the higher or optimised cooling efficiency allows a greater supply of energy into the system for a higher brightness/a better colour rendering/a longer lifespan and energy efficiency at a lower energy supply and a therefore generally cooler system is used. All these properties are supported by a smooth all-round radiance of light.

A current realistic and purposive structural shape of this LED light could have for example a brightness of approx. 710 lumen at a radiation angle of approx. 340 degrees and a colour temperature of 2900 Kelvin as well as a colour rendering of more than Ra90 as technical values, showing at the same time the common dimensions of a bulb diameter of approx. 55 mm with a total length (incl. E27 socket) of 97 mm. This is, fitted on a conventional E27 socket, at a power consumption of only 11 watt secondary sided, a substitute for a conventional 60 watt light bulb.

In an advantageous arrangement of the LED light according to the invention, the radiated light is made of eleven intersecting and overlaid radiating units, whereby these have a radiation angle of about 130 degrees. Although these are only values, which regard a constructional realisation of the LED lights at the current time. It is also possible to use lights with less, but especially with significantly more units, what leads to a reduction of the power of every single unit and especially causes optical differences, without abandoning the central idea of the invention. Here it is provided expediently, to prefix a diffuser, this causes an evenly scattered radiation of the light. This diffuser cap acts in this case as a dispersing lens.

The single light units, which are inserted into the bulb-shaped heat sink, are in an advantageous form of the invention constructed as nearly funnel-shaped bodies, which are inserted into recesses in the heat sink or inserted into several heat sinks embedded at the LED driver module. At this, the nearly funnel-shaped units can be formed of these heat sinks. These consist here of a funnel-shaped heat conducting outer aluminium, copper, or ceramic sheath or rather a sheath of a good heat conducting alloy or a good heat conducting composite material, in which a high performance LED is mounted on an aluminium, copper or ceramic circuit board or rather a circuit board made of a good heat conducting alloy or a good heat conducting composite material and which is closed up by a diffuser or a dispersing lens.

By taking this measure, a radiation angle of nearly 180 degrees is realized, whereby a closed even radiation is achieved, although the light is mounted by a huge number of individual LEDs. Another positive aspect of this arrangement is, that the comparatively bright light of the single units, which is in an expediently structural shape only of a radiating surface of the LED chips assumed as approx. 1 till 2 $mm^2$, distributed homogeneously by the dispersing lens and therefore the LED light doesn't dazzle the human eye as much when looking at it directly.

In an expediently version of this invention the dispersing lens or rather the diffuser cap is made of an acrylate-plastic, in which diffuser beads are included. This causes the even redirection of the radiation of light and the already mentioned distribution of the radiation in a wide radiation angle.

Alternatively it is possible to use a clear transparent medium instead of a diffuser as a closure. This increases the efficiency, for example for fields of application in which the lamp is suffixed to a diffuser. Although a universal applicability is not given and the illuminant is bound to a specific site of operation and can't be used at discretion at different sites of operation.

Another alternative is a narrowly bundling lens. Here it is reached, that single lights spread spot-like (effect like a disco ball), but this is of course not meeting the character of a conventional light bulb.

Another alternative is an adjustable lens, which is depending on the user-defined setting, widely scattered to narrow focused, to get a special user-defined mood of light.

Such a possibility in setting could be combined with directing the light in a particular direction which differs from the middle axis of the light module, as another advantageous alternative. The light beam radiating from the light module can be bundled, to accentuate for example a part of the room, that should be illuminated especially brightly. This could be controlled by radio signals or by overlaid signals in the feeding voltage or controlled manually or by being set.

Expediently the inner wall is shaped at a slant in the inner part of the funnel-shaped body, in which the LED circuit board is located, so that laterally escaping light from the LED "dome" or rather the LED will be reflected forward by those sloped areas, with the aim of increasing the light output emitted from the funnel-shaped body. The inner sloped areas are therefore reflectors. Expediently these areas are coated with a reflecting surface or coating, such as for example nickel, chrome, polished aluminium or a reflecting paint.

Expediently the LED circuit boards, which carry the LEDs and have a round contour, have an external thread laterally and are connected via this thread with an internal thread into the funnel-shaped body.

Expediently, to achieve a better heat transmission between LED circuit board and funnel-shaped body, a heat conducting paste or tape is superimposed onto the two joint faces, to optimise the heat conducting between LED circuit board and the funnel-shaped body. This heat conducting is further optimised by the power transmission of the connecting thread onto the joint surfaces.

In the case of the first structural shape a thread, a bayonet fitting or another mechanical frictional and/or form-fitting connection mounted expediently on a cylindrical stump of the funnel-shaped body of the units, which helps to connect the funnel-shaped body with the heat sink.

The funnel-shape of the body is here advantageous, because at the insertion of the funnel-shaped body into the funnel-shaped recesses of the heat sink an accelerative force forms between the inner area of the funnel-shaped exposure of the heat sink and the outer areas of the funnel-shaped body, which conduces the heat transmission. The outer areas of the funnel-shaped bodies are, during the screwing procedure for example, pressed flush into the funnel-shaped exposure of the heat sink. This has the advantage, that the heat exchange between funnel-shaped body and heat sink is optimised and it is possible, to do as far as possible without thermal conducting auxiliaries like heat conducting paste. The optimised heat exchange between the single elements means that, the whole system achieves a better cooling efficiency, and therefore the LEDs stay generally cooler, are more efficient and have a longer lifespan.

Another expedient construction regarding the structural shape 2 is the connection of the funnel-shaped self-cooling LED modules (including the heat sink and the LED light unit, as well as the dispersing lens) with the LED driver module via connection joints detachable by the user, which have also the task of transmitting electricity as well as fixing the module onto the carrier or rather the LED driver module. These could be for example so called jack plugs ("Klinkenstecker") or RCA plugs ("Cinchstecker"), as they are known from the entertainment industry.

The advantages of such a modular assembly, detachable by the user, would be for example the possibility to insert LED modules with different colours, to create a special kind of mood or even to place the LED modules irregularly onto the carrier module or rather the LED driver module, for example to illuminate just certain parts of a room, to create a special kind of mood or just to save energy, when there is no need to illuminate the whole room.

Expediently there is a LED driver arranged in the inner part of the heat sink of the LED light or rather centrally between the large number of heat sinks, whereby the electromagnetic radiation, which could result from such a LED driver, can be absorbed by the enclosing heat sink that means the heat sink has, in addition to its cooling function, also that of an electromagnetic shielding regarding the electronic components of the LED driver, which is necessary for transforming the current or rather the implementation of a potential dimming or control signal.

As detailed below the invention should be described more closely on the basis of drawings.

It depicts

Figure 2:
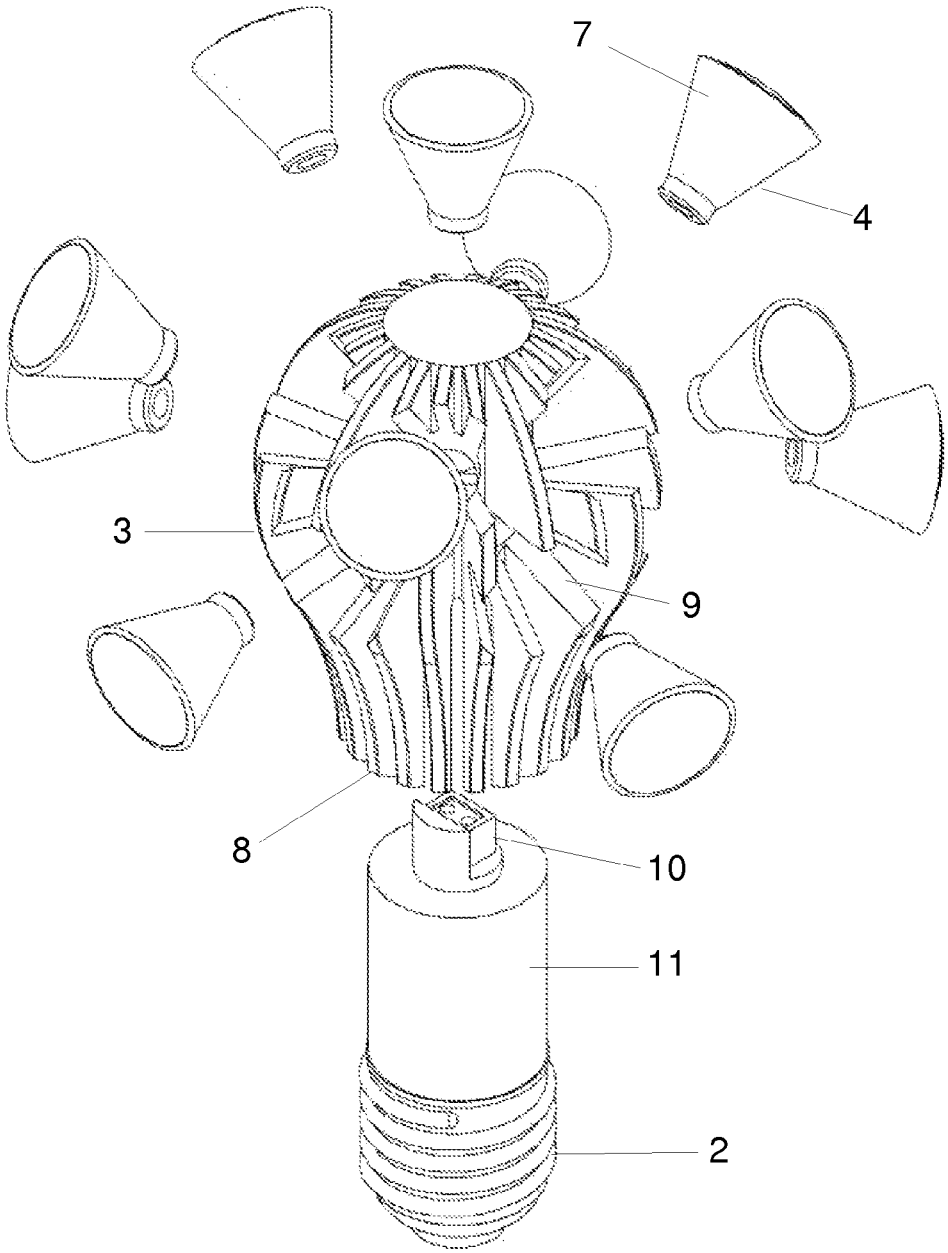
Figure 3:
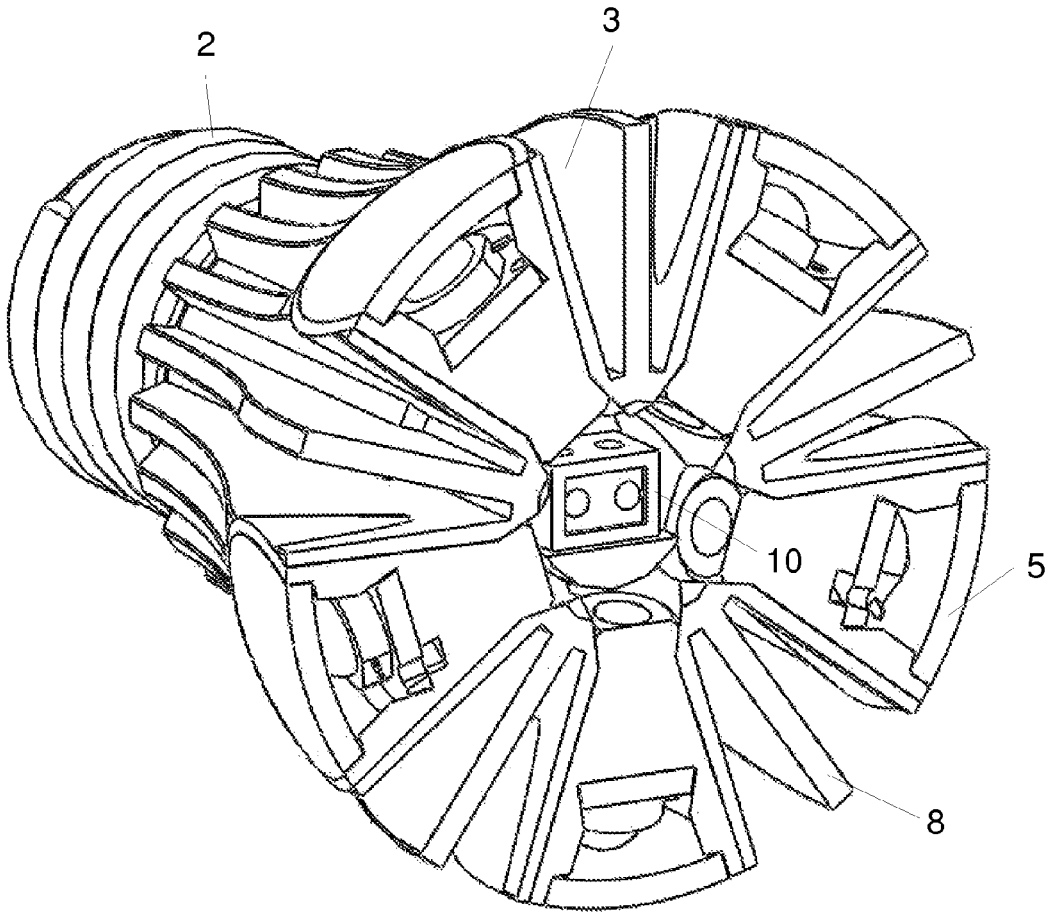
Figure 4:
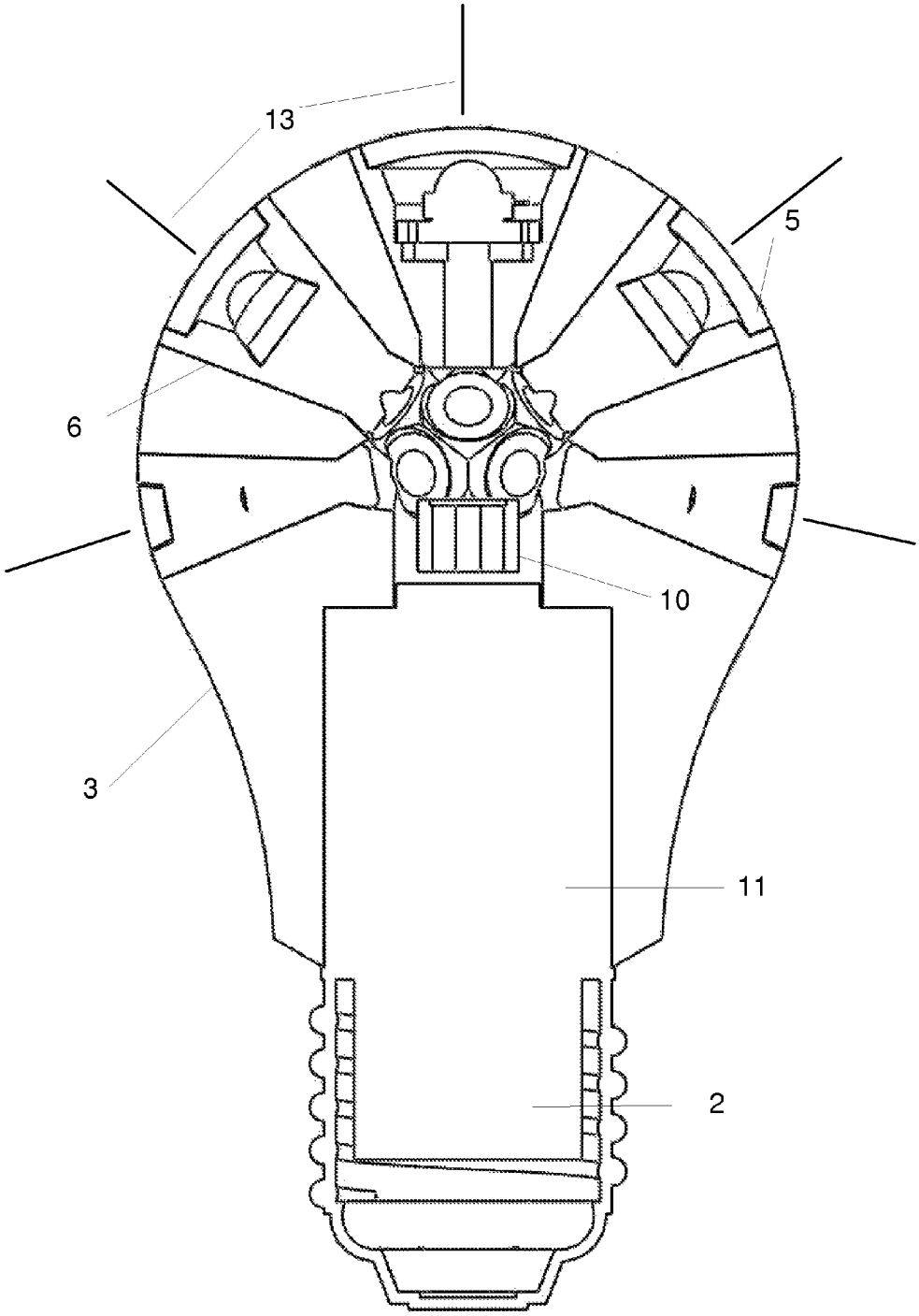
Figure 5:
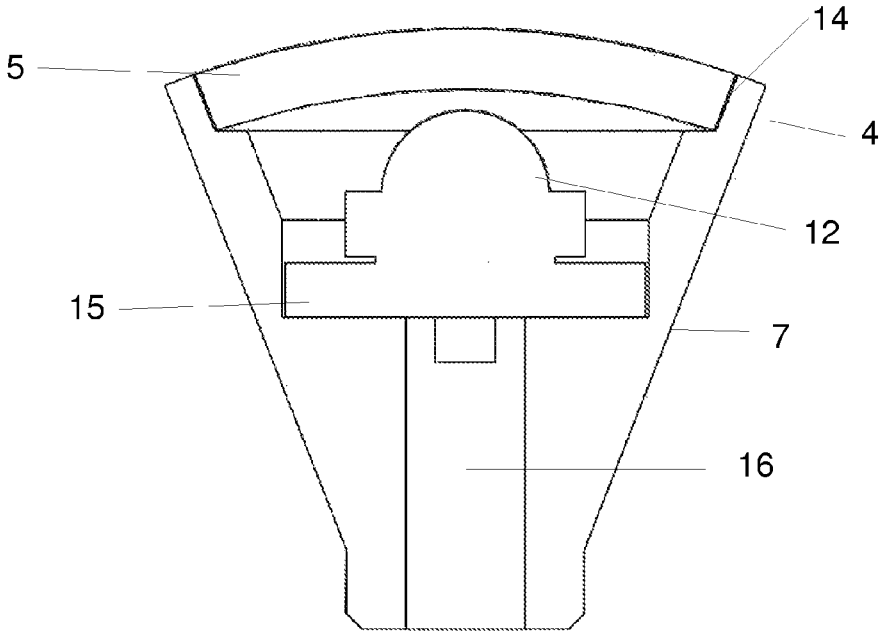
Figure 6:
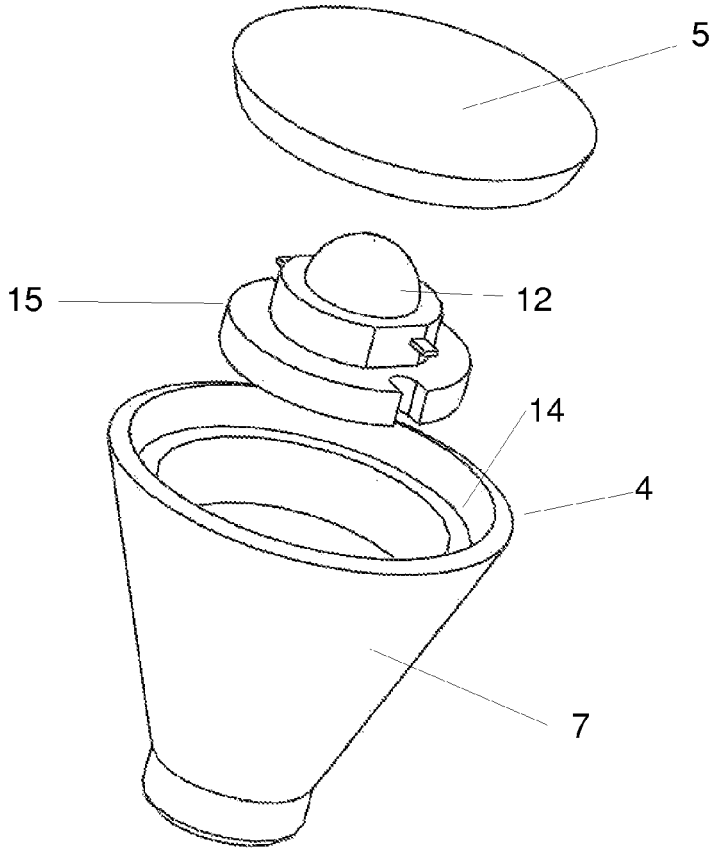
Figure 7:
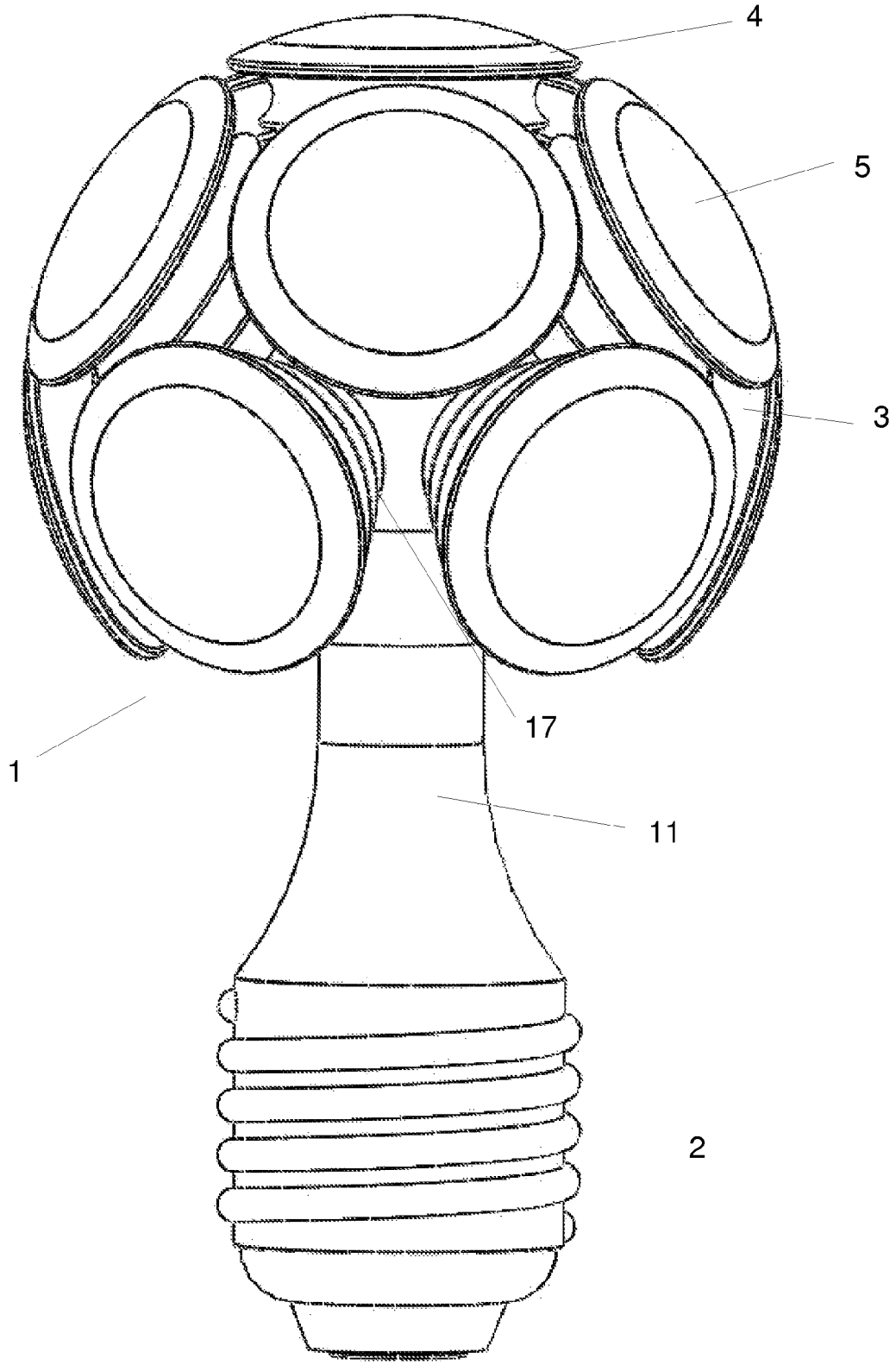
Figure 8:
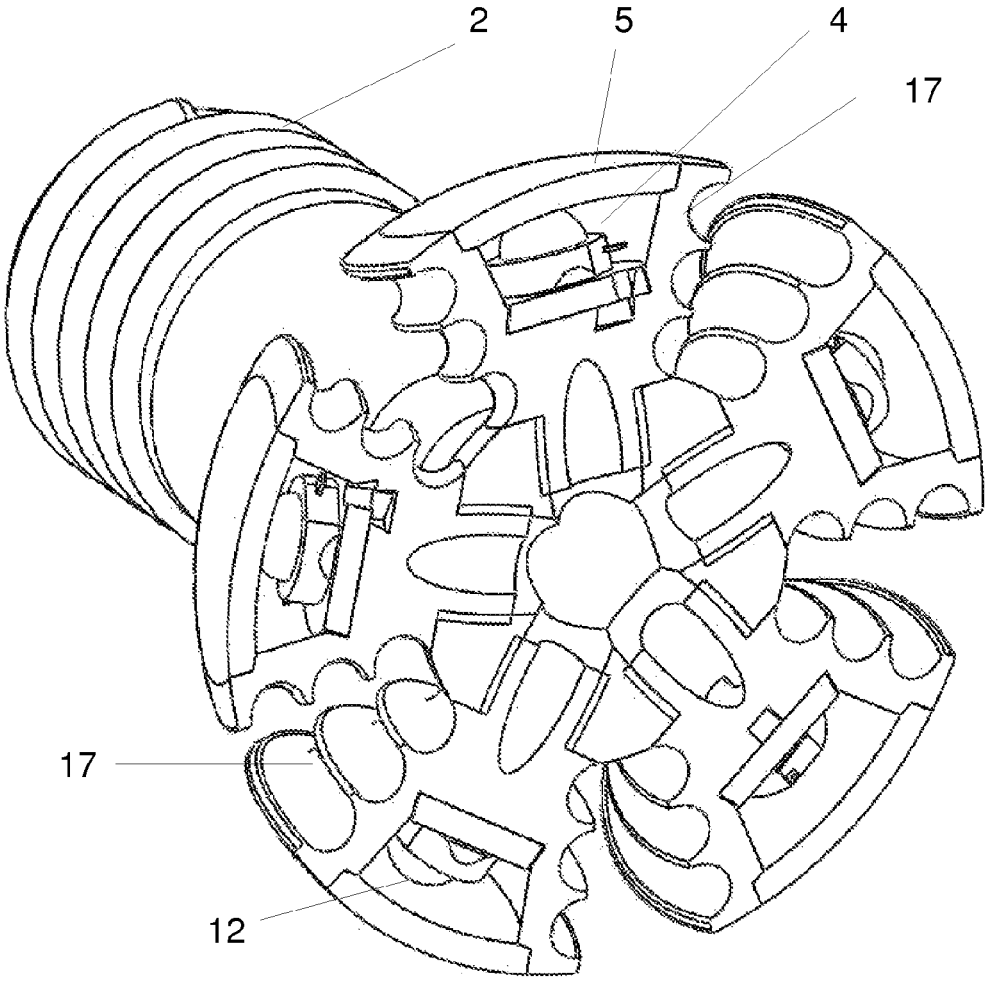
Figure 9:
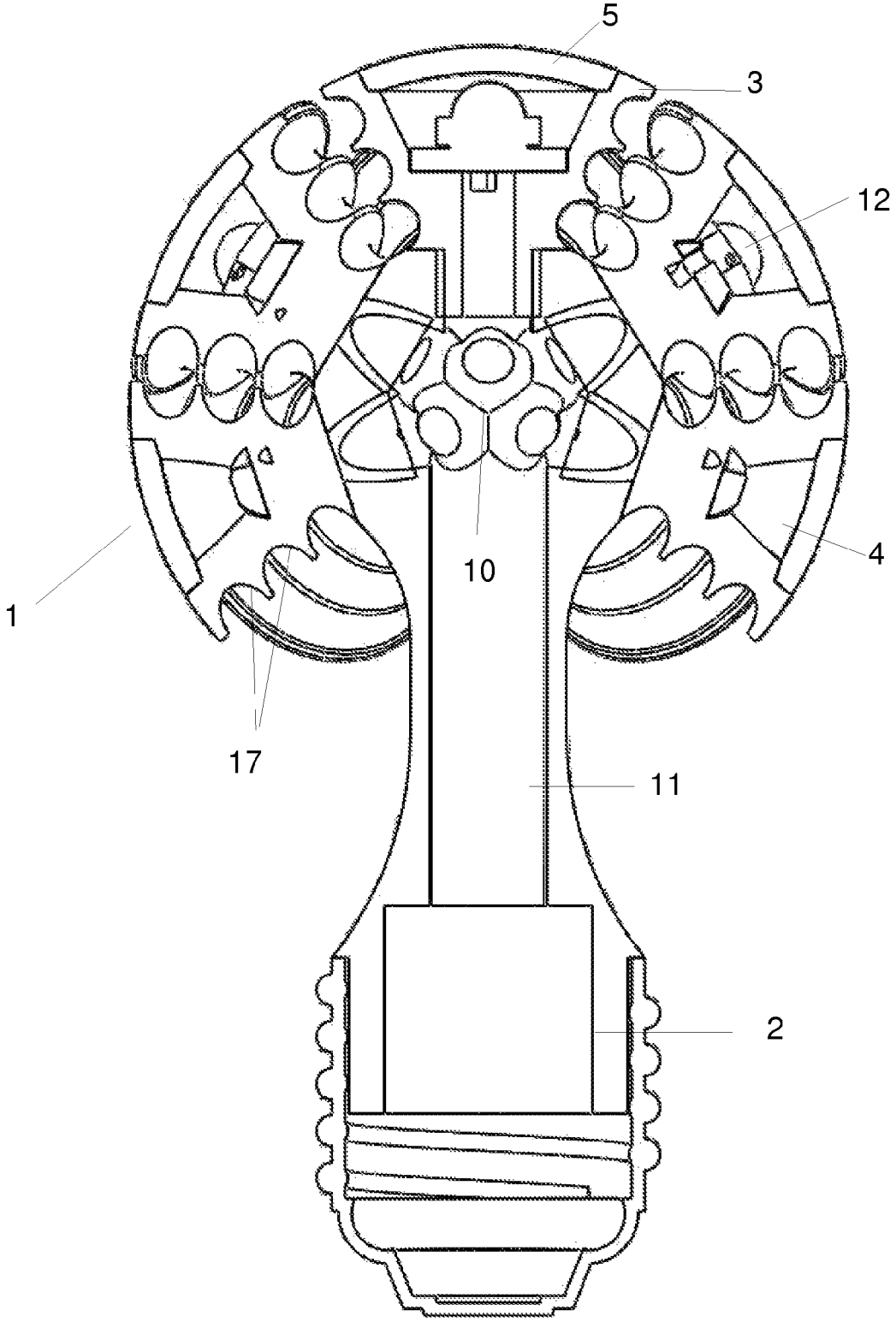
Figure 10:
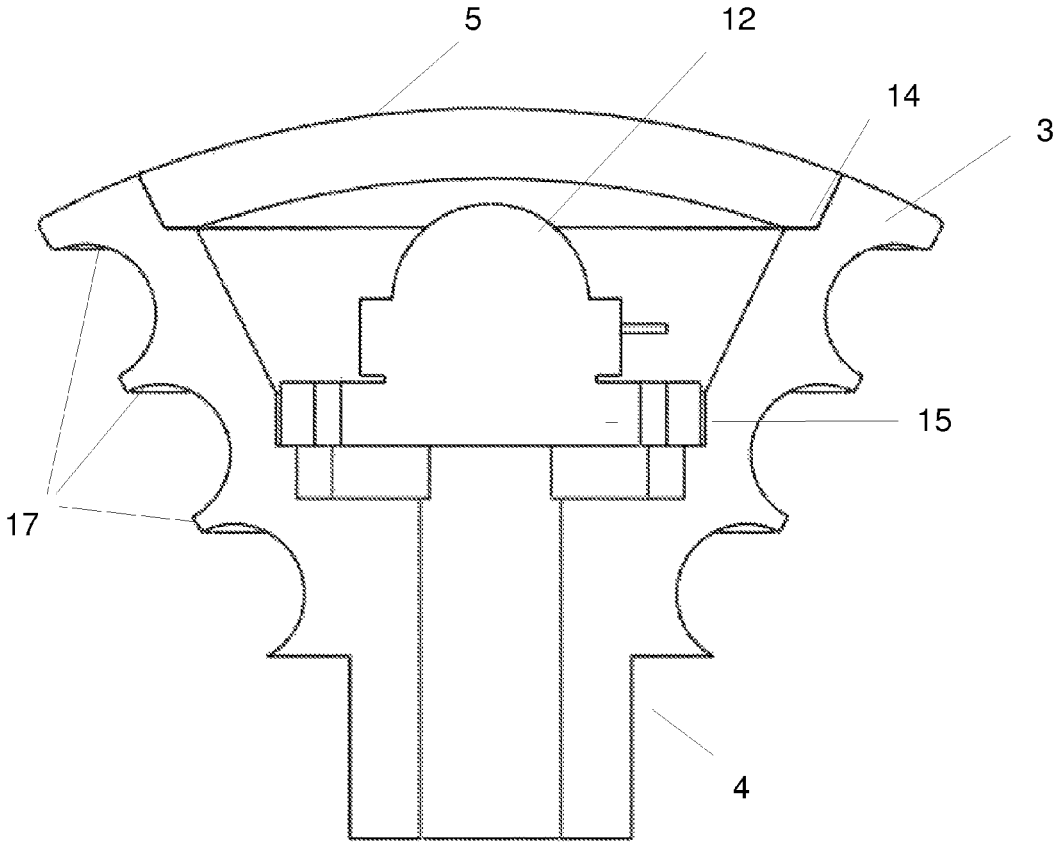
Figure 11:
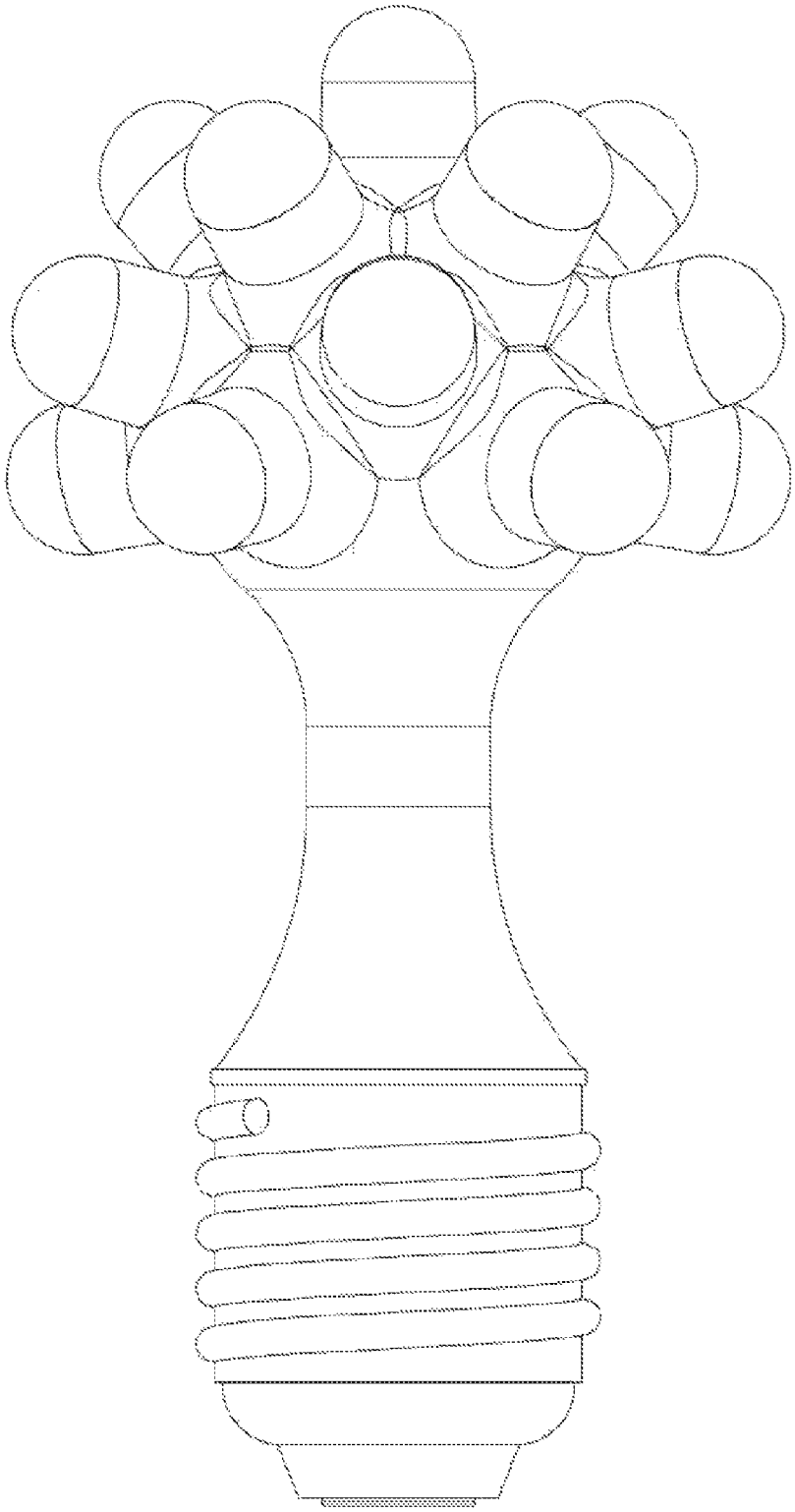
Figure 12:
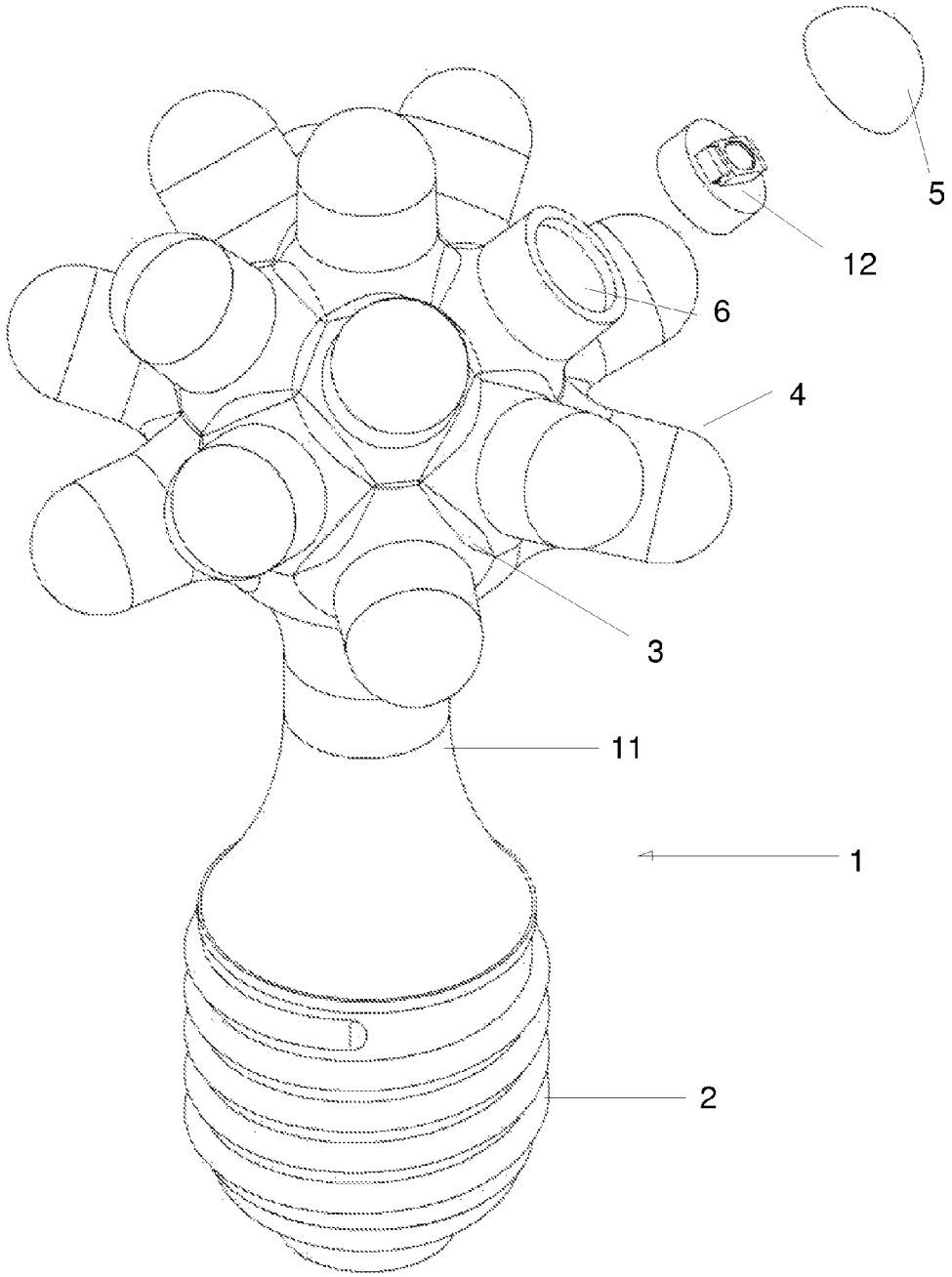
Figure 13:
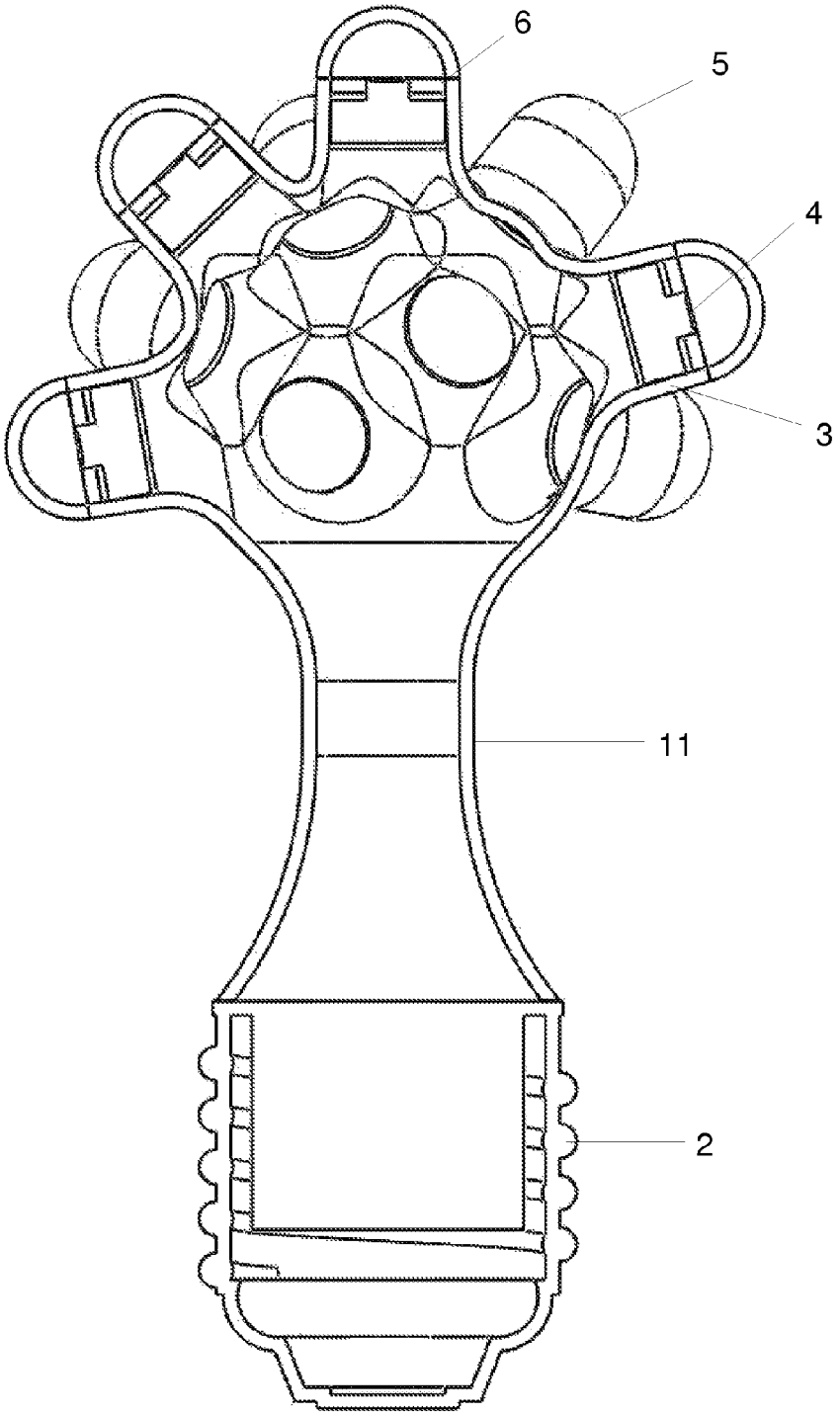

FIG. 1 A lateral general view of the LED light with a one-piece heat sink,

FIG. 2 An exploded drawing of the LED light with a one-piece heat sink,

FIG. 3 A horizontal cut through the LED light with an one-piece heat sink,

FIG. 4 A vertical cut through the LED light with a one-piece heat sink with radiation angles of the LED unit, FIG. 5 A lateral view of a unit of the LED light with diffuser cap, FIG. 6 An exploded drawing of such a unit, FIG. 7 A lateral general view of another structural shape of the LED light with several heat sinks, FIG. 8 A horizontal cut through another structural shape of the LED light with several heat sinks, FIG. 9 A vertical cut through another structural shape of the LED light with several heat sinks, FIG. 10 A lateral cut of a unit of the LED light with diffuser cap at another structural shape of the LED light with several heat sinks, FIG. 11 A lateral general view of a third structural shape of the LED light with several heat sinks, FIG. 12 A perspective general view of a third structural shape of the LED light with several heat sinks with exploded drawings of the unit, FIG. 13 A vertical cut through a third structural shape of the LED light with several heat sinks.

FIG. 1 shows the lateral view of the LED light 1 in total. Here it becomes clear, that the single units 4 are included in the bulb-shaped total heat sink 3. This heat sink 3 is shown in an exemplary shape, constructed of lamellae 8, which go out from the socket 2 and converging in the front tip of the LED light. These lamellae go out from a nearly cylindrical permeable core 11 of the LED light.

Between these lamellae 8 lay the single units 4 of the LED light 1, whereby one unit 4 points to the front and is located at the tip of the LED light 1. The other units 4 are arranged in two circular arrangements of 5 units 4 each evenly across the range of the LED light 1, whereby the spacing at the units 4 which lay on the lower ring closest to the socket and between the units 4 which are closer to the front tip of the LED light 1, are greater.

The units 4 themselves are recognizable as nearly funnel-shaped bodies, which are closed by a dispersing lens, which also acts as diffuser cap 5. These lay here in one plane of the bulb-shaped heat sink 3 itself and therefore do not protrude over the basic form of the LED light.

In FIG. 2 it becomes clear, how the LED light 1 is constructed. It consists for one thing of the socket 2, on which the LED driver 10 is mounted on a cylindrical part 11. Onto his cylindrical part 11 the real heat sink 3 is mounted with the cooling fins 8 showing radially outwards, whereby funnel-shaped recesses 9 are provided across the heat sink 3, in which the units 4 are insertable.

These units 4 consist of an outer sheath 7, also funnel-shaped, in which a high performance LED 12 is arranged on a base board 15 and which is closed by a dispersing lens or a diffuser cap 5. The constructional unit of the unit 4 is now inserted interlocking into the heat sink 3, whereby there are generally different possibilities of mounting, for example frictional connections, bolted connections or adhesive joints. After inserting the units 4 into the heat sink 3 they lay flatly with the dispersing lenses 5 against the contour of the heat sink, by which the endeavoured bulb shape of the LED light can be realized.

In FIG. 3 a horizontal cut above the LED driver 10 through the LED light bulb 1 is shown. This cut is made through the lowest circumferential line of units 4, so that the funnel-shaped outer sheaths 7 of this units 4 can be seen, as well as the inserted LEDs 12 on the base boards 15. These are closed by the diffuser caps 5 also noticeable in the cross-section.

It is noticeable, that the units 4 are aligned evenly radially emanating from the longitudinal axis of the LED light, whereby between the units 4 are considerable spaces, in which the lamellae of the heat sink 3 pass. It is evident here, that the single units 4 have good heat conduction over the adjacent cooling fins 8, as well as a heat transmission being prevented through the space of the units to each other.

In FIG. 4 is again a vertical cut through an upright standing LED light 1 shown, where it is especially visible here, that not only an even arrangement of the radiation 13 of the units 4 is intended radial to the longitudinal axis of the LED light 1, but also the distribution of the units 4 across the vertical going cutting plane of the LED light 1 occurs evenly. So that there is the first unit 4 arranged on the tip of the LED light 1 and the additional two lines in a nearly constant angle to this frontal first unit 4 out going to the central cutting point in the core of the LED light. In that way the invented LED light 1 achieves an even radiation of light 13 in connection with the diffuser caps 5 used and the surface condition of the heat sink 3 itself In FIGS. 5 and 6 there is a closer image of the units 4. FIG. 5 shows an exploded drawing in a perspective image, where it can be seen that the funnel-shaped outer sheaths 7 of the units 4 have a circumferential groove 14 on their upper side to accomodate the diffuser cap or rather the dispersing lens 5.

The circuit board 15 for accomodating the LED 12 has lateral grooves, to enable the cabling of the LEDs 12. The LEDs 12 accomodating the outer sheaths 7 have, as it can be seen in FIG. 6, a cylindrical drilling 16, to enable the connection to the LED driver 10 inside the core of the LED light 1.

FIG. 6 shows furthermore, what effect the prefixed diffuser cap 5 has regarding the dispersion and the even distribution of the light radiation. It can be seen that a strong dispersion occurs here, so that there is the impression that every single unit isn't that dazzling anymore.

FIG. 7 shows a lateral general view of another structural shape of the LED light 1 with several heat sinks 3, which carry one unit 4 each. The heat sinks 3 are also funnel-shaped constructed and oriented on the contour of a conventional light bulb concentrically arranged, so that a even radiation is realized.

The horizontal cut through this further structural shape of the LED light 1 in FIG. 8, shows several heat sinks 3, outgoing from their centre in a horizontal direction, in which the LED units 4 can be seen. In contrast to the vertically running structures of the lamellae of the first structural shape, these heat sinks 3 now have parallel running horizontal cooling fins 17 on their own, in the present structural shape 3 parallel cooling fins 17.

In the vertical cut of FIG. 9 through this further structural shape of the LED light 1 it can be seen, that also in horizontal direction the heat sinks 3 are arranged in an evenly concentrical manner. There is the LED driver module 10 arranged in the centre. It becomes clear, that there are channels between the heat sinks 3, where the ambient air of the LED light 1 is able to flow, to achieve an optimal cooling effect.

In FIG. 10 is shown a lateral image of the cut in a unit 4 of the LED light 1 with diffuser cap 5 at this further structural shape of the LED light 1 with several heat sinks 3 The half shell-shaped channels between the cooling fins 17 can be seen clearly. The inner walls are also constructed funnel-shaped, as in the units 4 of the first structural shape. It can thus be achieved, that the lateral radiation of light of the LEDs are reflected to the front, especially with a corresponding reflecting coating of the walls.

The cylindrical extension of the heat sink 3 which points downwards according to FIG. 10, carries joining means which aren't drawn here, for example an external thread. Also the inserted LED circuit board 15 can be connected by an external thread with the heat sink 3, which is also not depicted.

A third structural shape of the LED light 1 with several heat sinks 3 is shown in FIG. 11 in a lateral general view. Here the arrangement of the units 4 orients again on the contour of a classical light bulb. As in the previous structural shapes, an evenly concentrical arrangement of the LED light units 4 can be seen.

In compliance to the second structural shape, here are also several heat sinks 3 provided, which are going out from and are fixed on a central body which includes the LED driver module 10. However this central body is also constructed spherically, whereby on this central heat sink 3 the other heat sinks 3 are mounted with their units 4, which are constructed smaller. This structural shape can be realized as a structural shape with only one heat sink 3, whereby the nearly cylindrical exposures for the units 4 mounted on the round body are an integral constructional part of this one heat sink 3. Alternatively this cylindrical exposure could be also about separate heat sinks 3, which are detachably fastened onto the central spherical heat sink 3. There are more units 4 arranged around this central spherical body as in the previous structural shapes, giving the optical impression of a body of coral.

FIG. 12 This perspective general view of this third structural shape of the LED light 1 with an exploded drawing of the nearly cylindrical shaped unit 4, which carries a dome-shaped diffuser 5, makes this clear.

FIG. 13 A vertical cut through a third structural shape of the LED light 1 with several heat sinks 3, whereby the coral shape of this version becomes clear once again. It's made clear, that it is about a structural shape with only one heat sink 3, which has arm-like extensions, which form the exposures of the units.

The invention claimed is:

1. An LED light at least including one lamp socket, at least one heat sink as well as several LED light units, wherein the heat sink (at least one) outgoing from the lamp socket forms the spatial contour of the LED light, whereby there are several LED light units dispersed around the heat sink(s) arranged in exposures in the heat sink, which follow in their different radiation angles the course of the contour of the heat sink(s), whereby a variety of radiation of light of different radiation angles around the heat sink(s) of the LED light dispersing happens, whereby there are prefixed dispersing lenses to the light units to disperse the light evenly.

2. The LED light according to claim 1, wherein the contour of the LED light resulting from the heat sink is adapted to the well-known light-bulb shape.

3. The LED light according to claim 1 wherein the heat sink is formed as a body or is assembled of several individual heat sinks, which are directed around a mutual centre to form the contour of the LED light.

4. The LED light according to claim 1, wherein the heat sink is nearly bulb-shaped, whereby the light units are arranged in at least two parallel horizontal lines concentrically and evenly dispersed around the size of the heat sink and formed to its contour, so that there are different radiation angles in the vertical level, because of the bulb-shaped heat sink for this arrangement.

5. The LED light according to claim 1, wherein the lamp holder going out from an extension to the centre of the heat sink and carrying a LED driver as series electronic, whereby the axes of the radiation of the units dispersed around the heat sink, have their common central point of radiation in the centre of the nearly bulb-shaped heat sink.

6. The LED light according to claim 1, wherein the heat sink which accommodates at least eleven units dispersed around its circumference, the arranged unit consists of two parallel horizontal lines of five units each and one at the tip of the LED light.

7. The LED light according to claim 1, wherein the units implemented in the heat sink are formed of nearly funnel-shaped outer sheaths, in which a LED illuminant is included on a base board and in front of which finally a dispersing lens or rather diffuser cap is fixed, whereby these units are implemented and fixed into the interlocking exposures in the heat sink.

8. The LED light according to claim 1, wherein the units implemented in the heat sink are exchangeably used in the interlocking exposures in the heat sink and fastened there detachably.

9. The LED light according to claim 1, wherein the dispersing lens or rather diffuser cap, which is prefixed to the unit, made of acrylat-plastic with involved diffuser beads, for an even scattering of the radiated light.

10. The LED light according to claim 1, wherein the heat sink is formed of nearly parallel running lamellae, whereby the heat sink itself consists of good heat conducting material.

11. The LED light according to claim 1, wherein the heat sink is assembled of several separate heat sinks, which are fixed on the extension emanating from the lamp holder, whereby each heat sink accommodates one LED light unit.

12. The LED light according to claim 11, wherein the separate heat sink is funnel-shaped, whereby their sheath has on the outside parallel circumferential cooling fins, through which there are channels for the flowing air between the heat sinks.

13. The LED light according to claim 1, wherein the heat sink acts as a shielding element against electromagnetic radiation in the part of the LED driver which is located in the centre of the heat sink.

* * * * *